United States Patent [19]

Hsu et al.

[11] Patent Number: 4,466,993

[45] Date of Patent: Aug. 21, 1984

[54] PREPARATION OF FILM OF WEB-REINFORCED PHOTOPOLYMERIZED HYDROPHILIC INTERPOLYMER

[75] Inventors: Chin C. Hsu, Avon Lake; Stanley R. Goscewski, Lorain, both of Ohio

[73] Assignee: The B. F. Goodrich Company, Akron, Ohio

[21] Appl. No.: 464,306

[22] Filed: Feb. 7, 1983

[51] Int. Cl.[3] ..... B05D 3/06

[52] U.S. Cl. ..... 427/44; 118/264; 118/267; 118/DIG. 4; 427/54.1; 427/429

[58] Field of Search ..... 427/44, 54.1, 420, 429; 118/DIG. 4, 264, 267

[56] References Cited

U.S. PATENT DOCUMENTS

| | | | |
|---|---|---|---|
| 1,249,434 | 12/1917 | Loewenbach | 118/264 |
| 1,432,733 | 10/1922 | Reed | 118/267 |
| 2,060,897 | 11/1936 | Richardson et al. | 118/DIG. 4 |
| 2,293,174 | 8/1942 | Rooney et al. | 118/264 |
| 3,219,012 | 11/1965 | Stream | 118/DIG. 4 |
| 4,167,464 | 9/1979 | George | 204/159.14 |

*Primary Examiner*—John H. Newsome

*Attorney, Agent, or Firm*—Alfred D. Lobo; Nestor W. Shust; Alan A. Csontos

[57] ABSTRACT

A process is taught in which a flexible, reinforcing travelling web may be uniformly, thinly transfer-coated, on both sides of the web simultaneously, with a low-viscosity liquid or mixture of monomers which may or may not wet the web, but does not wet the surface of a substrate on which the web and mixture are deposited. The liquid or mixture is first curtain-coated on an applicator curtain against which the web moves in controlled contact. An apparatus is provided for transfer-coating a travelling web with a low-viscosity liquid which is first curtain-coated on an applicator curtain.

15 Claims, 4 Drawing Figures

Fig. 1
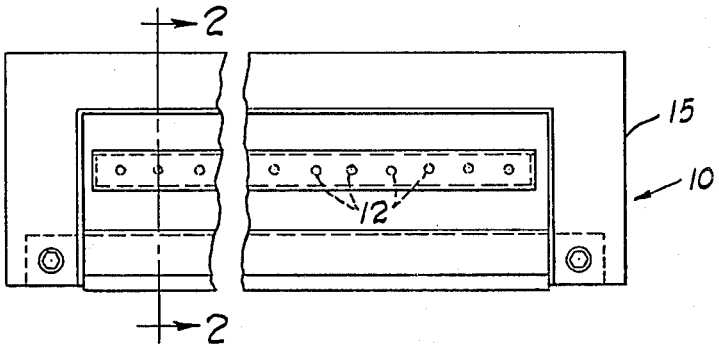
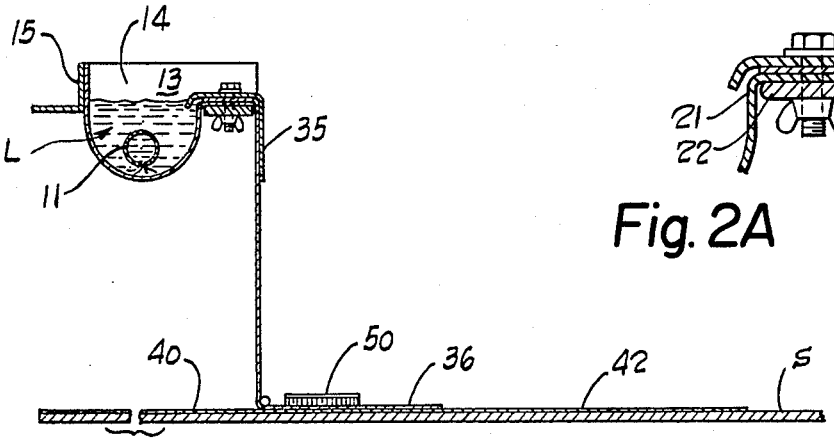
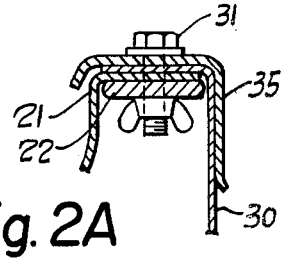
Fig. 2A
Fig. 2
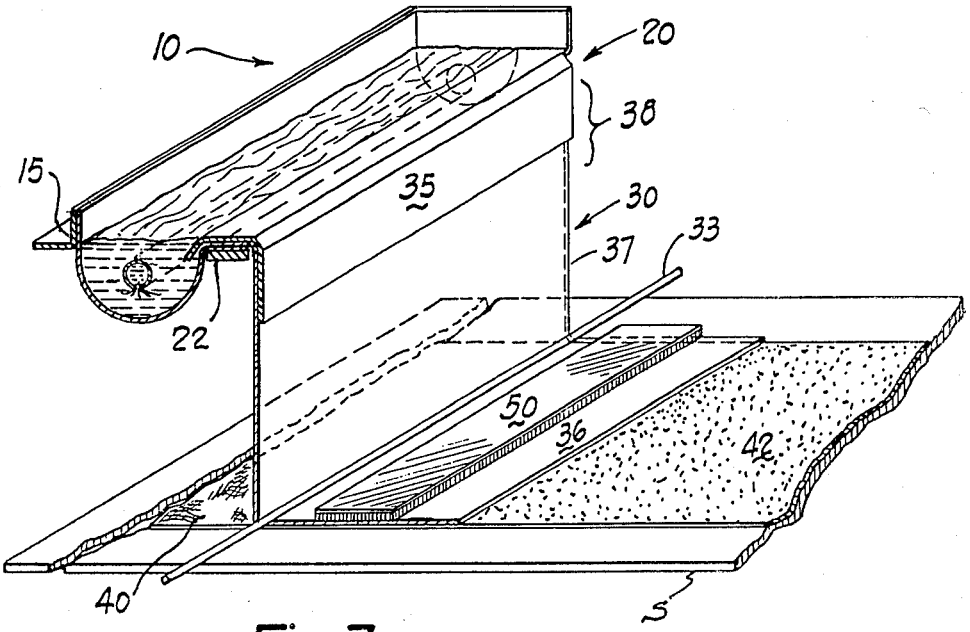
Fig. 3

PREPARATION OF FILM OF WEB-REINFORCED PHOTOPOLYMERIZED HYDROPHILIC INTERPOLYMER

BACKGROUND OF THE INVENTION

This invention relates generally to an apparatus and process for transfer-coating a low-viscosity polymerizable liquid from a curtain-coated applicator means to either a thin, delicate open-mesh or batte web which is embedded in a uniform liquid layer of substantially the same thickness as the web, and the liquid is then polymerized; or, to a continuous web forming a backing for the liquid.

This invention particularly relates to the production of a thin, web-reinforced sheet or film useful in applications which capitalize on the unique properties of a hydrophilic interpolymer. Monomers which are polymerized to form the interpolymer may be coated on a thin film of corona-treated polyolefin, specifically polyethylene, which is wetted by the monomers. Alternatively an open-mesh web or net of a polymer which is not wetted by the monomers confines them so as to envelop the net which provides reinforcing for the interpolymer.

Such an interpolymer may be prepared by the copolymerization of a low-viscosity liquid mixture of monomers comprising (a) an unsaturated carboxylic acid and (b) a salt of the unsaturated carboxylic acid in which the majority of the carboxylic groups has been neutralized with an alkali metal hydroxide or ammonium hydroxide, in the presence of one or more of the following monomers selected from the group consisting of (i) a higher alkyl (meth)acrylate (that is, acrylate or methacrylate), (ii) a lower alkyl (meth)acrylate, (iii) an alpha-olefin having from 6 to about 18 carbon atoms, styrene or a substituted styrene, (iv) a cross-linking agent which contains two or more ethylenic unsaturations, and (v) 2-hydroxyethyl methacrylate or dialkylaminodialkyl (meth)acrylate. These interpolymers are known to absorb water and body fluids such as urine and blood, rapidly, as disclosed in U.S. Pat. No. 4,167,464, and copending patent applications Ser. Nos. 183,616; 389,822; and 427,325, the disclosures of which are incorporated by reference thereto as if fully set forth herein.

The problem is that utilization of these desirable properties of the interpolymer is thwarted by the difficulty of incorporating it in a product with a suitable woven fabric or non-woven batte made from textile fibers because of the peculiar, particular properties of a mixture of monomers from which the interpolymer is formed. The term "mixture of monomers" is used herein even when the polymer is formed from (a) acrylic acid and (b) an alkali metal or ammonium acrylate, and such polymer is referred to herein as an interpolymer as these monomers are distinct from each other.

By "fibers" we refer to filamentous elements which are organic natural fibers or synthetic fibers such as those produced from spinnerets which fibers may be used to form a batte of random or oriented fibers, or to form yarn which in turn may be woven into a fabric or netting. In addition to the peculiar property of low-viscosity, the liquid has a high proclivity to polymerize in the nozzle of a spray gun from which it is sprayed, making spray-coating a web of fabric impractical.

In practice, the interpolymer is prepared by photopolymerizing, preferably in the presence of a photoinitiator and a dispersant, (a) from about 10 to about 60 percent by weight (wt. %) of acrylic acid, (b) a salt formed by neutralization of 40 to 90% of the acrylic acid with an alkali metal hydroxide or $NH_4OH$, and optionally, (i) less than 25 wt % of a higher alkyl (meth)acrylate wherein the alkyl group has from 10 to about 30 carbon atoms; (ii) less than 30 wt % of a lower alkyl (meth)acrylate wherein the alkyl group has from 1 to 8 carbon atoms, a minor amount, or none, of the lower alkyl (meth)acrylate being replaced by (meth)acrylic nitrile or amide; (iii) hexene or styrene; (iv) less than 10 wt % of a cross-linking agent having two to six ethylenically unsaturated groups which can be copolymerized with acrylic acid by UV radiation; and (v) from 5 to 35 weight percent of 2-hydroxyethyl methacrylate or dialkylaminoalkyl (meth)acrylate in which each alkyl of the dialkyl groups has 1 to 8 carbon atoms, and the other alkyl group has 2 to 6 carbon atoms; so that the polymerized film formed contains in excess of 25% water.

By a low-viscosity liquid mixture we refer to a liquid which has a viscosity in the range from about 2 to about 100 centipoises (cp), more specifically from about 8 to about 30 cp, which is referred to herein as being 'non-viscous' because the mixture defies being coated, so as to form a continuous liquid layer, on many a substrate surface if it is not either 'etched' or especially formed so as to restrict the run-off of the liquid.

For example, even with the use of a surface active agent or dispersant, the mixture of monomers does not wet, but runs off, a laminar substrate of nylon, untreated polyester or polyolefin. With a dispersant included in the mixture, it wets paper, cotton, wool or polyester surfaces, but only with difficulty. A woven fabric of nylon or polyester fibers, such as a net, when dipped in the mixture and held so as to hang in a vertical position, retains almost none of the mixture even when the interstices of the net are only about 1 mm in diameter. Even a non-woven batte of nylon or polyester fibers is wetted with difficulty. The problem can best be visualized by comparing it to the problem of coating a net with concentrated sulfuric acid at room temperature, so that the acid uniformly fills the interstices of the net.

To combat this problem, the '464 patent teaches the use of a wicking aid such as a glycol, to improve the rate at which the liquid moves along the fibers or film being coated, if the liquid wets them at all. However, even with a wicking aid, it is difficult to wet a horizontally supported reinforcing nylon net or non-woven nylon batte with the mixture of monomers, and we know of no prior art teaching as to how such reinforcing might be wetted sufficiently to embed it in a thin, substantially uniform liquid layer of the mixture. By "thin" we refer to a thickness from about 2 mils to about 25 mils thick, and by "substantially uniform" we refer to such thickness ±20%.

The addition of cross-linking agents may improve the strength of the polymer formed by the action of actinic radiation, but the use of a cross-linking agent in an amount sufficient to improve the wettability of the reinforcing material adversely affects the desirable properties of the polymer formed. Thus, to the extent such wettability may be improved, it is accomplished with a choice of dispersants.

The '464 patent teaches that the interpolymer has particular utility in the disposable non-woven industry where there is a need for polymers which will absorb and retain water and physiological fluids. In a specific example, it teaches a disposable diaper in which fibers of the interpolymer, or non-woven agglomerates of its fibers may be included; or, in which diaper a film of the interpolymer may be used between a fluid-impermeable outer plastic layer and inner fluffy absorbent layer of the diaper. There is no teaching of the use of a reinforced film of the interpolymer, with the reinforcing web embedded intermediate the upper and lower planar surfaces of the film, because there did not exist a practical method of making such reinforced embedded film for use in a marketable article of commerce. The problem of coping with the peculiar physical properties of the mixture of monomers in which the reinforcing material is embedded by a method which forms a thin continuous film of the interpolymer, had yet to be solved.

Numerous prior art methods have been devised for coating low viscosity liquids on substrates, each of which methods is directed to the solution of particular problems presented by the properties of the fluid to be coated and the substrate upon which it is to be coated. Brush-coating of a web is generally restricted to the application of relatively thick coatings of relatively viscous fluids having a viscosity greater than 100 cp, is known to leave undesirable streaks and other non-uniformities with coatings less than 25 mils thick, and is therefore avoided in the coating of low-viscosity liquids. Further, when the web is an easily unraveled batte, or an easily distorted net of a filament from about 1 mil to about 10 mils thick, maintaining the integrity of the web becomes a critical consideration.

Most methods for coating low-viscosity liquids in which a web is embedded are directed to the production of textiles or textile-like fabrics which are unrelated to the web-reinforced articles of this invention both in appearance and in function. Moreover, these methods are directed to the curtain-coating of a controlled thickness of a polymerizable non-viscous fluid, in the range from about 2 mils to about 25 mils, on to a travelling web; very few of these are directed to the further problem of stripping or delaminating the reinforced polymer film from a substrate not wetted by the fluid and upon which substrate the polymer is formed. To our knowledge, no prior art method useful for coating a controlled thickness of a low-viscosity liquid teaches the use of a stationary curtain-coated (with the liquid) applicator curtain with the specific purpose of transferring a thin coating to a moving web.

Stated differently, knowing that a thin net or batte (web) cannot be coated uniformly with a thin layer of the non-viscous mixture of monomers by being dip-coated, or spray coated, or coated from a transfer roll, knife over-roll, squeeze roll, or reverse roll such as are conventionally used for relatively low-viscosity liquids, and knowing the mixture cannot be coated on the thin web by rotagravure coating as is routinely done with low-viscosity inks and the like, the particular problem is to embed the web, which is wetted by the mixture, in a substantially uniform liquid layer from 2 to about 25 mils thick while the web is supported on a substrate. In an additional step, after the woven or non-woven web of reinforcing material is embedded in the non-viscous mixture, then polymerized, the reinforced interpolymer film must be parted from the substrate upon which it is polymerized.

The uniform flow of liquid from weir-like structures including a reservoir from which a moving web is coated, the direction of movement of the web being transverse to the longitudinal axis of the reservoir, has been considered generally difficult to control. Conventional reservoirs with a weir, and a curtain supplying liquid across the weir, are known to produce non-uniform flow across the length of the weir, which proscribes their use where uniformity is essential. Such reservoirs are also known to be sensitive to pulsing of the liquid flowed into the reservoir, which proscribes their use where a thin film is to be curtain-coated on a web. Accordingly, the conventional weir-like structure has been replaced with structures such as those disclosed in U.S. Pat. Nos. 3,365,325 and 3,369,522.

More recently, U.S. Pat. Nos. 3,587,527; 3,911,174; 4,019,906; 4,075,976; 4,178,221 and 4,197,812 address particular curtain-coating problems, and how they may be solved by obviating the conventional weir-type structure, the tendency of droplet formation with a curtain which does not terminate in a knife-edge, and other problems. Though none of the disclosures is particularly directed to curtain-coating with a low-viscosity liquid, and, examples provided are of liquids having substantially higher viscosities than 100 cp, it is clear that one skilled in the art when faced with the particular aforementioned problems, would not be led to use a curtain coated web as an applicator from which the liquid is to be transferred to another web.

Reverting to the '464 patent, it is stated that a film of the monomer mixture can be spread on the surface of a suitable substrate to the desired thickness, e.g. 1 mil to 25 mil, and then subjected to UV radiation for a short time, e.g. 1 second to several minutes. Substrates mentioned are Mylar, polyethylene, and paper, inter alia, but it was not recognized that the monomer mixture wetted only etched polyethylene and that non-corona treated Mylar® was not wetted at all. Therefore, on such non-wettable surfaces, the mixture of monomers cannot be spread by conventional methods such as with a Boston-Bradley adjustable blade or by spraying.

Further, since from a practical standpoint, the polymer is formed by exposure to UV radiation at a sufficient intensity to effect a cure in a short time in the range of from about 20 sec to about 40 secs, it is essential that the reinforcing material be substantially permeable to the UV radiation. By "substantially permeable" we mean that not enough UV radiation is absorbed by the mass of fibers to deleteriously affect their properties or those of the interpolymer formed. For example, paper and natural organic fibers get too hot to be useful as reinforcing material.

Thus, to our knowledge, the problem of polymerizing a uniform, thin, continuous liquid layer of a non-viscous mixture of plural monomers by exposure to ultraviolet radiation, or electron beam radiation where the polymer formed is to be reinforced with a substantially uv-permeable reinforcing material, is a novel problem which has not been successfully solved.

SUMMARY OF THE INVENTION

It has been discovered that a flexible reinforcing travelling web may be uniformly, thinly transfer-coated, on both sides of the web simultaneously, with a low-viscosity liquid such as a mixture of monomers which may or may not wet the web, but does not wet the surface of a substrate support or conveyor on which the web and mixture are deposited, if the mixture is first curtain-coated on an applicator curtain against which the web moves in controlled contact. An apparatus is provided for transfer-coating a travelling web with a low-viscosity liquid which is first curtain-coated on an applicator curtain.

It has further been discovered that a travelling web, particularly an open-mesh web, which has been transfer-coated as described immediately hereinabove may then be photopolymerized by intense uv-radiation, if flow of the mixture on the substrate support or conveyor is restricted by the web, and the web is substantially permeable to the uv-radiation used, though the open-mesh web is formed from a polymer which is not wetted by the mixture.

It is accordingly a general object of this invention to provide a process for embedding a thin, easily distorted or unraveled web in a substantially uniform thin liquid layer from about 2 to about 25 mils thick, the liquid being characterized as having a viscosity in the range from about 2 cp to 99 cp. Such a process is also applicable to coating a thin corona-treated polyethylene film with such a layer which upon polymerization forms a thin hydrophilic film backed by the polyethylene film.

It is another general object of this invention to provide a transfer-coated, web-reinforced photopolymerized film of uniform thickness made from at least two photopolymerizable monomers present as a mixture confined by the web which is placed on a conveyor, though the mixture does not wet either the web or the conveyor.

It is a more specific object of this invention to provide a net-supported film from about 2 to about 15 mils thick, of a hydrophilic interpolymer formed by uv-radiation curing (polymerization), preferably in the presence of a photoinitiator and a dispersant, of a mixture of (i) about 50 to 90 percent by weight (wt %) of acrylic acid in which from 60 to 90% of the carboxylic groups have been neutralized with an alkali metal hydroxide or $NH_4OH$, (ii) 0 to 25 wt % of a higher alkyl (meth)acrylate wherein the alkyl group has from 10 to about 30 carbon atoms, and, (iii) 0 to 30 wt % of a lower alkyl (meth)acrylate wherein the alkyl group has from 1 to 8 carbon atoms, 0 to 50% of said lower alkyl (meth)acrylate being replaced by (meth)acrylic nitrile or amide.

It is another specific object of this invention to provide a novel apparatus for the purpose of curtain-coating an applicator curtain from a reservoir with a weir-like structure, so that a low-viscosity liquid having a viscosity greater than 2 cp but less than about 100 cp, gravitatingly flowed along the applicator curtain, can then be transfer-coated upon a travelling web such as a net while the net is supported on a moving substrate, though the mixture does not wet either the net or the substrate, and which apparatus effectively produces a substantially uniform liquid layer of the mixture in the range from about 2 to about 25 mils thick, in which liquid the net is submerged.

It is still another specific object of this invention to provide an oxygen-permeable burn-wound dressing which has particularly desirable properties with respect to the transport and absorption of body fluids generated in proximity to the wound, for which dressing it is critical that the thickness of the reinforced film be in the range from about 2 to about 25 mils.

It is a further specific object of this invention to provide an article for personal use, such as a diaper, sanitary napkin or the like, comprising a woven or non-woven synthetic fiber web which physically confines a mixture of monomers to be photopolymerized, though the web is formed from a polymer not wetted by the mixture and absorbs none of the mixture; which web when embedded in the interpolymer must have a substantially uniform thickness of from 2 to about 25 mils; and, when the web is a net, because the net is uv-permeable, it functions as a reinforcing material which physically confines the mixture of monomers to prevent its flow so that it can be uv-radiation-polymerized without deleteriously affecting the reinforcing material.

BRIEF DESCRIPTION OF THE DRAWINGS

The foregoing and other objects and advantages of our invention will appear more fully from the following description, made in connection with the accompanying drawings of preferred embodiments of the invention, wherein like reference characters refer to the same or similar parts throughout the several views and in which:

FIG. 1 is a top plan view, with a portion broken away, of a portion of a novel apparatus including a reservoir constructed in accordance with this invention.

FIG. 2 is a side elevational view of the reservoir taken along the line 2—2 in FIG. 1, showing its elevated position with respect to a moving substrate (conveyor belt) which carries a web on its surface, which web is to be embedded in a liquid issuing from the reservoir.

FIG. 2A is a detail in cross-section, showing how the feathering means and applicator means are held on the lip of the reservoir means.

FIG. 3 is an elevated perspective view, partially in cross section, of the reservoir, web and conveyor belt, showing additional details.

DETAILED DESCRIPTION OF PREFERRED EMBODIMENTS

In one preferred embodiment, this invention relates generally to embedding a thin delicate open-mesh web ("net") in a uniform layer of low-viscosity liquid, having a viscosity in the range from about 2 cp but not exceeding 100 cp; after which the liquid-embedded net may be treated as desired. The net may be formed from a polymer the surface of which is wetted by the liquid, in which case the liquid is held in and around the net by surface tension and other forces, facilitating the embedding of the net in the liquid. Alternatively, the net may be formed from a polymer the surface of which is not wetted by the liquid, as is the case with polyethylene, polyester and nylon net, yet the liquid is physically confined within and around the net. In the most preferred embodiment, such non-wetted nets are preferred for their strength and a process is taught for continuously producing a net-reinforced, thin polymeric sheet or film, particularly useful as a burn wound dressing or sanitary napkin, by using a known interpolymer composition in a UV-fiber-fixable process. By "UV-fiber-fixable process" I refer to a process in which the interpolymer adheres to certain natural or synthetic resinous fibers forming the web, and which will bond these plural fibers together, the interpolymer being formed when a mixture of plural monomers is exposed to UV radiation and which interpolymer after being so fixed, may be removed from a substrate on which it is formed because the monomers do not wet the substrate, whether or not they wet the net. Stated differently, the release property of the UV-polymerized interpolymer is attributable to the surface of the substrate upon which it is formed and not to the effect of a particular component of the interpolymer.

The fibers may be of any material desired, such as wool, glass, or cellulosic materials including cotton, rayon, and wood pulp, but are preferably the synthetic fibers produced from fiber-forming polymers including polyamides, polyacrylonitrile, polyesters, polyurethanes, polyethylene, polypropylene, polyvinylidene chloride and the like, as long as the fibers of the web (net or batte) are substantially permeable to UV radiation. Since both the natural and synthetic fibers, if present either in substantial bulk and density as a batte or as a yarn heavier than about 10 mils in diameter to form the net, are generally not sufficiently UV-permeable under the conditions of UV-polymerization used in a commercial process, the web used herein is necessarily a delicate batte or net.

By "delicate" batte we refer to a batte which can be unraveled or pulled apart with a force of 8 ounces or less, exerted by attaching a weight by means of a clamp 1 inch wide to the hanging batte. Typically, such a batte will weigh less than 50 g/m$^2$, and preferably from about 10 to about 25 g/m$^2$. By "delicate" net we refer to a net formed with a filament from about 45 to about 150 denier, or 2 to about 10 mils in diameter, and preferably from 2 to 5 mils in diameter, the interstices of the net being in the range from about 5 mils to about 0.25 inch in diameter, and the net is easily visibly distorted by a force of 8 ounces or less, exerted as before.

Since the fibers, whether woven as a net or non-woven as formed in a random or oriented batte, are embedded, that is completely submerged, in the interpolymer, the surface area of the interpolymer where it is in contact with the fibers, when added to the remaining surface area of the interpolymer including that area which is exposed to the atmosphere, is greater than the surface area of the fibers. This physical criterion, along with the appearance of the reinforced interpolymer film, serves to distinguish the reinforced article formed by the process of this invention from prior art reinforced articles in which the interpolymer was used. For example the interpolymer was formed on a continuous corona-treated Mylar TM polyester film, or etched polyethylene film, which formed a backing (substrate) for one planar surface of the interpolymer.

It is generally preferred to prepare a thin web of non-woven batte of fibers using a continuous fiber technique as shown in Belgian Pat. No. 608,646, or by the use of short lengths of fibers, that is, fibers having an average length of about 0.125 to about 0.5 inch, and the fibers are placed horizontally so that the thickness of the batte is less than about 25 mils. If the thickness of the batte is more than 25 mils it may be compressed to a predetermined thickness in the range from about 2 to about 25 mils, from 2 to about 10 mils being more preferred.

Through fibers may be used as a non-woven batte in this invention, it is preferred to employ a yarn made from synthetic fibers, which yarn is woven or otherwise formed into netting preferably having interstices in the range from about 10 mils to about 50 mils in average diameter, the yarn itself having a diameter corresponding approximately to the thickness of the liquid to be confined within and upon the net. Further description of the invention will be made with respect to the use of a nylon or polyester net reinforcement, these being the most preferred reinforcing materials.

Referring now to the drawing, and particularly to FIGS. 1 and 2 thereof, there is shown a liquid reservoir means indicated generally by reference numeral 10 set transversely with respect to a longitudinally extending endless conveyor belt referred to herein as a conveyor S. Liquid L is pumped by a metering pump (not shown), the liquid entering through a supply tube 11 having plural through-passages 12 in open fluid communication with the interior of a walled trough 13 having a wall 14 extending peripherally on three of its sides, and the wall is preferably reinforced exteriorly with angle iron 15 which may be used to mount the trough. The passages 12 serve to supply the liquid substantially uniformly along the length of the trough 13, near the bottom thereof.

One transverse side of the trough provides a weir means indicated generally by reference numeral 20, formed by a transverse lip 21 having a flattened upper surface over which the liquid overflows substantially uniformly at a preselected rate set by the metering pump and correlatable to the thickness of the liquid layer in which a net 40 is to be embedded. A clamping means such as an elongated clamping plate 22 extends beneath the lip so as to clamp one transverse (upper) edge of an applicator curtain means 30 between the plate and lip 21 when clamping screws 31 are tightened. The applicator curtain 30 hangs vertically and is trained under a hold-down edge means 33, such as a wire or rod means. The wire or rod 33 is positioned transversely to the direction of movement of the net 40 on conveyor S. The portion of the applicator curtain under the wire or rod extends in a horizontal plane as horizontal portion 36, coextensively upon the substrate S. Thus liquid L flowing over the lip 21 gravitates along the vertical portion 37 of the applicator curtain forming a curtain of liquid which is slowed as it descends, by the applicator curtain.

A "feathering" member 35, preferably made from a strip of fabric, is draped across the lip 21 and is removably affixed thereupon, extending along the entire length of the lip 21, with the lower portion of the strip 35 in overlapping contact with the applicator curtain 30 along a smoothing zone 38 contiguous to the lip. The feathering means thus serves to feather and distribute the overflowing liquid more uniformly across the vertical portion of the applicator curtain 30. Without the feathering means 35, liquid L overflowing the lip 21 is found to flow unevenly across the vertical portion of the curtain.

The net 40 is fed along the surface of the conveyor S and in liquid-transferable contact with the applicator curtain 30. The height of the rod or wire 33 above the conveyor S is preset so as to be only slightly greater than the thickness of the net, so as to allow formation of a uniform liquid layer of preselected thickness. It is preferred to set the rod or wire at a height in the range from about 1 mil to about 5 mils greater than the thickness of the net as viewed in side elevation, and most preferred to set it about 1 to 2 mils greater. The conveyor S thus provides a means for continuously transporting the net 40 beneath and away from the reservoir to permit the transfer of a layer of liquid from the applicator curtain onto the net.

Because the applicator curtain is preferably a woven fabric, the liquid L wets both sides of it and gravitates to the net 40, and is transferred to it substantially uniformly because of the peculiar wiping contact of the web 40 with the wetted applicator curtain 30 so a to form liquid-embedded net 42.

To ensure even greater uniformity of the liquid layer in which the net is embedded so that both the upper and lower surfaces of the net are coated with a lamina of liquid, a dressing means 50, such as a roller, brush or pad, is disposed in contact with the upper surface of the horizontal portion 36 of the applicator curtain, the force exerted by the dressing means 50 being established by a little trial and error, as is expected to be done in the art.

The net 40 travels from beneath the horizontal portion 36 embedded in an uniformly thin liquid layer, and as embedded net 42 travels to a subsequent processing step. In the most preferred embodiment the net 42 on the conveyor S is conducted under an intense UV radiation source having an intensity at least 100 watts/inch for a short period of time sufficient to form the interpolymer which coats all surfaces of the net.

The quantity of liquid applied to the net is substantially correlatable to the thickness of the net to be embedded therein because the viscosity of the liquid is such that the liquid not held by the net will run off the net and the substrate's surface. Since a very thin layer of liquid less than about 1 mil thick is most preferably formed as a lamina both above and below the embedded net 42, the weight of the liquid always exceeds the weight of the net 40 and is generally several times greater, depending upon the physical properties of the web 40 and the liquid in which it is to be embedded.

Since the mixture of monomers most preferred for use in this invention is essentially permeable to UV radiation, a photoinitiator is used such as is disclosed in the '464 patent, a preferred amount being in the range from about 0.1 to about 1% by wt of the liquid. In addition, there may be included an air cure promoter, cross-linking agents and the like, as is known in the art.

In addition to the foregoing essential monomeric components of the mixture, minor amounts, that is, less than 5% by wt of the liquid, of additional monomers may be added to tailor the physical and chemical properties of the interpolymer. Among these additional monomers are 1,2-monoolefinically unsaturated nitriles, monoolefinically unsaturated amides including N-alkyl(meth)acrylamides, N-alkyol (meth)acrylamides, N-alkoxy (meth)acrylamides, and the like, disclosed in the '464 patent.

If desired, pigments may be added to the liquid and also inert fillers such as talc, but it should be recognized that these absorb UV light to a greater or lesser degree, and will slow the curing process, and may heat the curing resin to an unacceptably high temperature. It is preferred to maintain the temperature during polymerization in the range from about 65° C. to about 130° C., and a temperature in the range from 70° to 90° C. is most preferred.

Any commercially available medium pressure mercury (Hg) lamp source of radiation in the range from about 2000 Å to about 5000 Å, which supplies from about 100 to about 300 watts/in is preferred for exposing the liquid, and the irradiation may be accomplished in stages if so desired. The atmosphere during irradiation may be an inert gas, but air is preferred. Since the UV source and means for exposing the web 42 are well known in the art, no further details are necessary and are not illustrated in the drawing.

In the best mode, this invention is carried out with a polyester net on which an interpolymer is preferably formed with (i) acrylic acid in which from about 80 to 100% of the carboxylic groups have been neutralized; (ii) a higher alkyl (meth)acrylate having the structure

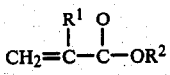

wherein $R^1$ represents hydrogen or methyl, and $R^2$ represents alkyl having from about 10 to about 18 carbon atoms, for example, isodecyl methacrylate, lauryl methacrylate, stearyl methacrylate and the like; (iii) a lower alkyl (meth)acrylate having the structure

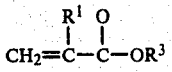

wherein $R^1$ has the same connotation as hereinabove, and $R^3$ represents alkyl having from 1 to about 8 carbon atoms, for example, methyl acrylate, ethyl methylacrylate and the like, present in an amount in the range from about 7 to about 17 wt % of the mixture of monomers, a minor portion of which lower alkyl (meth)acrylate may be replaced with (meth)acrylic nitrile or amide; and, (iv) from about 0.01 to about 5 wt % of a photoinitiator.

Another low-viscosity mixture of monomers consists essentially of (a) 90 to 99.9wt % of acrylic acid in which 50 to 100 percent of the carboxylic groups have been neutralized with an alkali metal or ammonium hydroxide prior to polymerization,
(b) 0.1 to 10 wt % of a cross-linking agent which contains two or more ethylenic unsaturations,
(c) 0.01 to 5 wt % of a photoinitiator, based on the total weight of acrylic acid and cross-linking agent, and
(d) a sufficient amount of water so that the resulting film contains 25 to 45 wt % of water.

Still another mixture of monomers consists essentially of (a) 70 to 95 wt % of acrylic acid in which from 70 to 100 percent and more preferably 80 to 100 percent, of the carboxylic groups have been neutralized with an alkali metal hydroxide or ammonium hydroxide prior to polymerization, and
(b) 5 to 30 wt % of a comonomer selected from the group consisting of an alphaolefin having 6 to 18 carbon atoms, styrene or a substituted styrene.

Yet another mixture of monomers consists essentially of (a) 65 to 95 wt % of acrylic acid in which from 60 to 100 percent of the carboxylic groups have been neutralized with an alkali metal hydroxide or ammonia base prior to polymerization,
(b) 5 to 35 wt % of a comonomer selected from the group consisting of 2-hydroxyethyl methacrylate and dialkylaminoalkyl (meth)acrylate wherein each alkyl of the dialkyl groups has 1 to 8 carbon atoms, and the other alkyl group has 2 to 6 carbon atoms,
(c) 0.01 to 5 wt %, based on the total weight of the monomers, of a photoinitiator,
(d) 0 to 5 wt %, based on the total weight of the monomers, of a cross-linking agent which contains two or more ethylenic unsaturations, and,
(e) a sufficient amount of water so that the resulting film contains 25 to 45 wt % of water.

Upon polymerization, the interpolymer may be dried in a convection oven to adjust the water content which is preferably at least 10 wt % based on the weight of the web-reinforced film. If so dried, the volume of the interpolymer shrinks and the surface is not planar but slightly undulating, depending upon mainly the degree of drying and the characteristics of the web. The uv-cured web-reinforced interpolymer may be stripped from the substrate and rolled, as is conventionally done.

The reinforced web has a firm feel and ample strength for use in "personal care" end products such as diapers, sanitary napkins and the like, and is especially desirable for burn-wound dressings.

It should be noted that whether the web is wetted by the foregoing mixture of monomers, or not, the surface of the conveyor S is not wetted, so that after the interpolymer is formed, the web-reinforced sheet or film may be dry-stripped from the substrate S.

In an analogous manner, a dilute aqueous solution of a water-soluble film-forming polymer such as polyvinyl alcohol or polyethylene oxide, having a viscosity in the range from about 10 to 99 cp, is transfer-coated on a randomly oriented batte transported on an endless conveyor belt (substrate). The batte is wetted by the dilute solution, and the wetted batte is dried on the belt. This method is particularly adapted for coating a 5% solution of Polyox TM WSR N-10 polyethylene oxide having an approximate molecular weight of 100,000 and a viscosity in the range 10–20 cp (at 25° C.); or, a 5% solution of WSR N-80 having a mol wt of 200,000 and a viscosity of 55–95 cp. Though undiluted polyvinyl alcohol has a viscosity in the range from about 25,000 to about 35,000 cp the diluted solution has a viscosity less than 100 cp.

The invention is further described in the following illustrative examples in which particular low-viscosity liquids are transfer-coated on thin webs.

EXAMPLE 1

A 9 gallon stainless steel (316) air-tight mix tank equipped with a motor-driven agitator and an internal cooling coil, is used to prepare a first solution (A) by charging the tank with 7.654 kg of 45% aqueous KOH, 4.427 kg of glacial acrylic acid and 1.116 kg of demineralized water, the acid being metered in over about 30 mins to maintain the temperature below about room temperature (75° F.). A premixed solution (B) of 0.781 kg glacial acrylic acid, 36.3 g of Irgacure TM 651, 225 g of Pluronic TM F-38, 104 g of polyethyleneglycol diacrylate (PEGDA), 282 g methyl methacrylate, and 114 g lauryl methacrylate is added to the mix tank. After the mixture is well-mixed, the tank is evacuated and the vacuum broken with nitrogen until the pressure is 25 psig. This evacuation and pressurizing may be repeated.

The mixture of monomers in the tank has a specific gravity of about 1.2 and a viscosity of about 15 cp measured with a Brookfield viscometer, Model LVT at 60 rpm. This mixture is pumped to a reservoir of a coating line equipped with an applicator curtain and coating head 11 ins wide. The conveyor belt is a glass fiber reinforced silicone rubber which passes at a speed of about 10 ft/min under 8 medium pressure Hg arc lamps having a total power of 1400 watts/inch, and thereafter, through convection drying ovens for adjusting the moisture level of the UV-cured hydrophilic polymer film.

A web of corona-treated embossed polyethylene film, 2 mils thick, is transported on the belt in contact with the applicator curtain from which it is coated with a substantially uniform liquid layer of monomers 1.8 mils thick. The liquid wets the surface of the PE film and is held thereon while it is exposed to the uv-radiation.

The interpolymer film contains 681 parts per million (ppm) of residual monomers and has a water content of 30.7%. This film absorbs 24 times its weight of a simulated urine solution containing 1% sodium salt. The hydrophilic film adheres strongly to the polyethylene backing and is not delaminated. It is especially suitable for the liner of a diaper.

EXAMPLE 2

In an analogous manner as in example 1 hereinabove, this mixture of monomers is coated onto a Travis #501 nylon net made from 70 denier yarn with a $26\times32/in^2$ count, which net is supported on the conveyor belt moving at about 3 ft/min in the same equipment as used in example 1 hereinabove. Varying thickness of film are produced in the range from about 2 mils to about 10 mils by adjusting the rate at which the mixture is metered to the reservoir and the speed of the conveyor belt.

The net-supported interpolymer is easily delaminated from the conveyor belt. The net is found to be completely embedded in the interpolymer with no uncoated surface of the net visible. Heavier denier yarn is preferably used for thicker hydrophilic films which typically contain from about 30 to about 50% water and less than 1000 ppm of unreacted monomers. The water content is adjusted by further drying, depending upon the choice of particular application for the net-reinforced film. Longer periods of polymerization may be used to decrease the unreacted monomers to within the range from about 10 to about 200 ppm.

EXAMPLE 3

In a manner analogous to that described hereinabove, the mixture of monomers is coated on a randomly oriented batte of glass fibers. Other mixtures of monomers prepared from recipes given hereinabove are also transfer-coated on continuous thin films of treated polyethylene, open-mesh nylon webs, and battes, all of which may be polymerized and delaminated from the conveyor belt, as described hereinbefore.

We claim:

1. A method for transfer-coating a laminar web with a low-viscosity liquid, comprising, (a) continuously flowing said liquid having a viscosity in the range from about 2 centipoise (cp) but below 100 cp, into a reservoir at a rate correlatable to a predetermined thickness of a liquid layer to be formed, (b) overflowing said liquid from said reservoir so as to provide a feathered overflow forming a gravitating curtain of liquid having vertical and horizontal flow components provided by an angulated applicator curtain means, (c) continuously transporting a thin delicate web beneath and away from said reservoir, said web being in liquid-transferable contact with said applicator curtain and a conveyor upon which said web is disposed, and (d) transferring onto said web a substantially uniform layer of said liquid, said layer having a thickness in the range from about 2 mils to about 25 mils.

2. The method of claim 1 wherein said liquid is a polymerizable mixture of monomers, and including the additional step of polymerizing said liquid to form a hydrophilic film.

3. The method of claim 2 wherein said web is substantially permeable to ultraviolet radiation or electron beam radiation sufficient to effect said polymerization.

4. The method of claim 3 wherein said liquid is a polymerizable mixture of monomers comprising, (a) an unsaturated carboxylic acid, and (b) a salt of the unsaturated carboxylic acid in which the majority of the carboxylic groups has been neutralized with an alkali metal hydroxide or ammonium hydroxide, in the presence of one or more of the following monomers selected from the group consisting of (i) a higher alkyl (meth)acrylate,
(ii) a lower alkyl (meth)acrylate,
(iii) an alpha-olefin having from 6 to about 18 carbon atoms, styrene or a substituted styrene
(iv) a cross-linking agent which contains two or more ethylenic unsaturations, and,
(v) 2-hydroxyethyl methacrylate or dialkylaminodialkyl (meth)acrylate.

5. The method of claim 3 wherein said method is a UV-fiber-fixable process in which said web is an open-mesh net formed with a filament from about 2 mils to about 10 mils in diameter.

6. The method of claim 3 wherein said method is a UV-fiber-fixable process in which said web is a batte weighing less than 50 g/m$^2$.

7. The method of claim 3 wherein said web is a continuous treated film of polyethylene, nylon or polyester having a surface which is wetted by said liquid.

8. The method of claim 4 wherein said net is formed from a polymer having a surface which is not wetted by said liquid.

9. The method of claim 4 wherein, said net is not wetted by said mixture, said liquid layer is slightly greater in thickness than said net, and,
said substrate is not wetted by said liquid.

10. The method of claim 5 wherein, said batte is not wetted by said mixture, said liquid layer is slightly greater in thickness than said batte, and,
said substrate is not wetted by said liquid.

11. The method of claim 8 wherein polymerizing said liquid is effected by exposing said mixture and web to sufficiently high energy ultraviolet or electron beam radiation for a period of time sufficient to form said hydrophilic film.

12. An apparatus for producing a laminar web-reinforced film of a polymer by transfer-coating a thin, delicate web with a polymerizable low-viscosity liquid layer having a thickness greater than that of said web, said apparatus comprising, (a) reservoir means with a lip including a walled trough having a weir means over which said liquid is overflowed,
(b) an applicator means in fluid communication with the liquid in the reservoir having vertical and horizontal portions, said vertical portion being removably suspended from beneath said weir means so as to permit flow under gravity of said liquid flowed on to said vertical portion at a predetermined flow rate,
(c) feathering means removably disposed upon said lip and a portion of said applicator means overlapping said vertical portion of said applicator curtain means along a smoothing zone contiguous to said lip, to feather and distribute the liquid uniformly across said vertical portion,
(d) edge means to form an angle between said vertical and horizontal portions,
(e) conveyor means not wettable by said liquid, for continuously transporting said delicate web beneath and away from said reservoir, said web being in liquid-transferable contact with said applicator curtain and conveyor upon which it is disposed and,
(f) means for polymerizing said liquid to form a laminar web-reinforced film of polymer.

13. The apparatus of claim 12 wherein said edge means is a rod or wire transversely disposed relative to the longitudinal direction along which said web is transported, the height of said rod or wire above the conveyor being only slightly greater than the thickness of said web.

14. The apparatus of claim 13 wherein said means for polymerizing said liquid is a high energy ultraviolet radiation or electron beam radiation source sufficient to polymerize said liquid in a preselected period of time, and said liquid is a mixture of monomers comprising (a) an unsaturated carboxylic acid, and
(b) a salt of the unsaturated carboxylic acid in which the majority of the carboxylic groups has been neutralized with an alkali metal hydroxide or ammonium hydroxide, in the presence of one or more of the following monomers selected from the group consisting of
(i) a higher alkyl (meth)acrylate,
(ii) a lower alkyl (meth)acrylate,
(iii) an alpha-olefin having from 6 to about 18 carbon atoms styrene or a substituted styrene,
(iv) a cross-linking agent which contains two or more ethylenic unsaturations, and,
(v) 2-hydroxyethyl methacrylate or dialkylaminodialkyl (meth)acrylate.

15. The method of claim 11 wherein said web is substantially permeable to said ultraviolet or electron beam radiation.

* * * * *